United States Patent [19]

Kuonen et al.

[11] 4,046,100

[45] Sept. 6, 1977

[54] APPARATUS FOR THERMAL DEPOSITION OF METAL

[75] Inventors: Frederick L. Kuonen, Euclid, Ohio; Edward M. Boughton, Palos Verdes Estates, Ohio

[73] Assignee: TRW Inc., Cleveland, Ohio

[21] Appl. No.: 719,284

[22] Filed: Aug. 31, 1976

Related U.S. Application Data

[60] Division of Ser. No. 623,647, Oct. 20, 1975, Pat. No. 3,995,073, which is a continuation-in-part of Ser. No. 459,010, April 8, 1974, abandoned.

[51] Int. Cl.[2] ..... B05C 11/00

[52] U.S. Cl. ..... 118/8; 118/47; 219/76

[58] Field of Search ..... 118/6, 7, 8, 9, 47, 118/302; 219/76; 427/8-10

[56] References Cited

U.S. PATENT DOCUMENTS

| | | | |
|---|---|---|---|
| 2,734,478 | 2/1956 | Reynolds et al. | 118/8 |
| 2,867,541 | 1/1959 | Coghill et al. | 427/8 |
| 3,574,650 | 4/1971 | House | 118/7 |
| 3,813,509 | 5/1974 | Woods et al. | 219/76 |

*Primary Examiner*—Ronald Feldbaum

[57] ABSTRACT

In a method and an apparatus for depositing metal on a surface of an article, the surface of the article is heated to a state of incipient fusion. During the heating, a light beam is directed at the surface and the light reflectivity of the surface is detected. At the time of incipient fusion, an electrical control signal is created from the light reflections. Metal is deposited on the surface of the article after incipient fusion thereof and control of the deposit of the metal is effected in response to the electrical control signal.

9 Claims, 7 Drawing Figures

FIG. 1
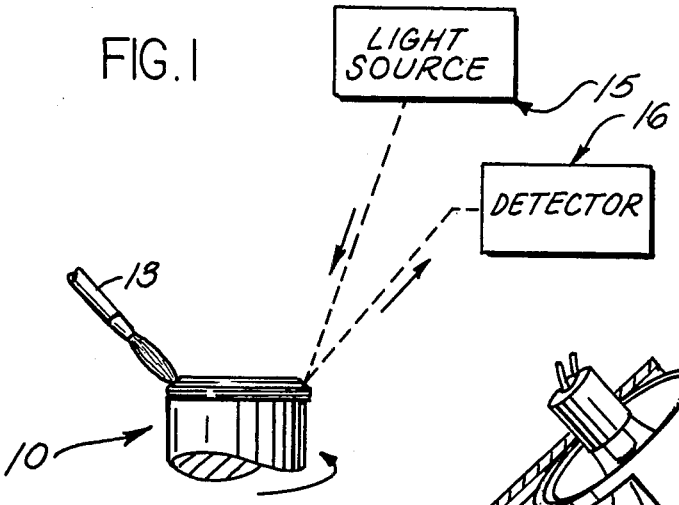
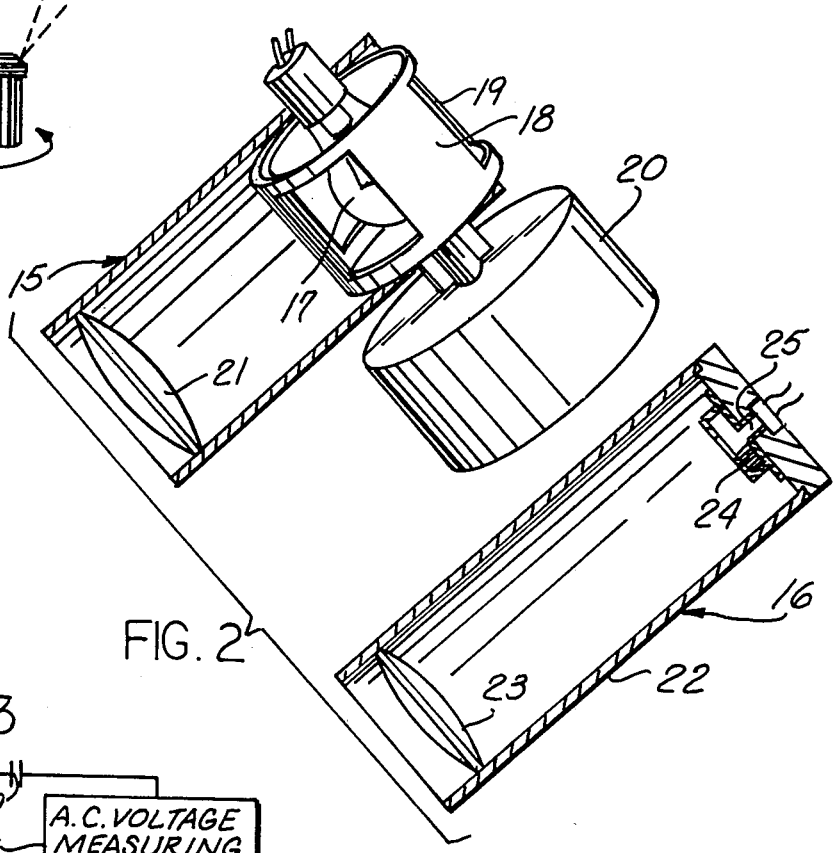
FIG. 2
FIG. 3
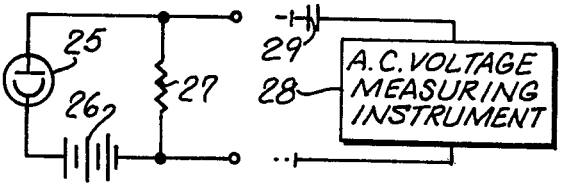
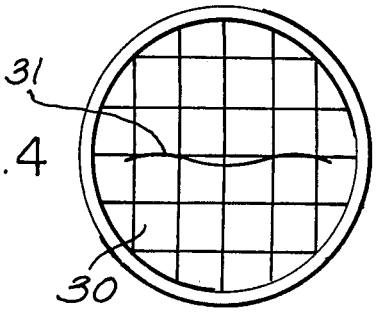
FIG. 4
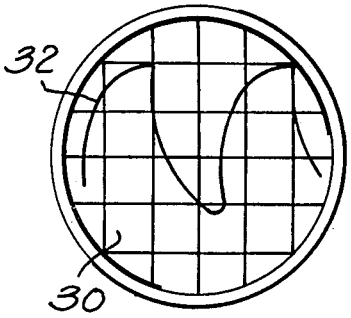
FIG. 5

FIG. 6
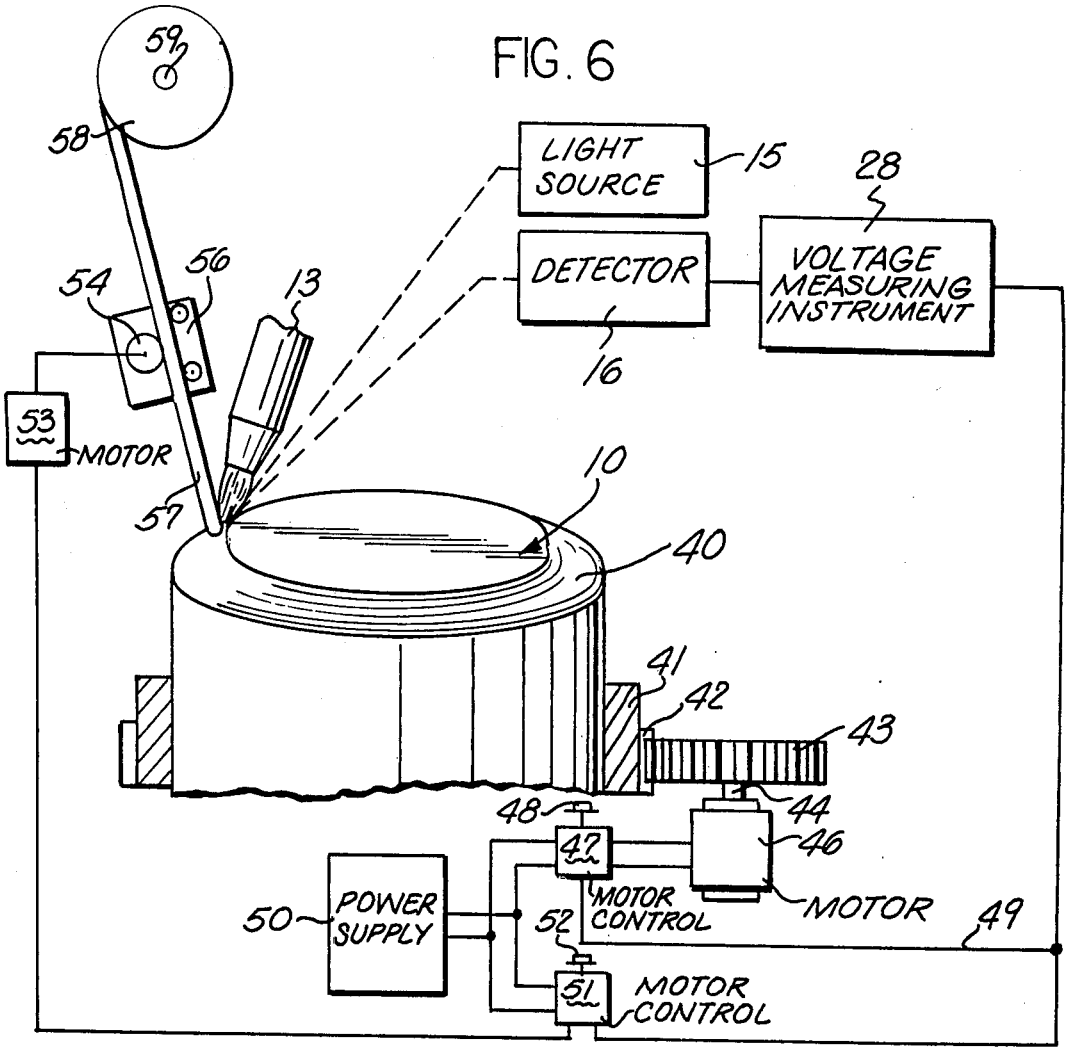
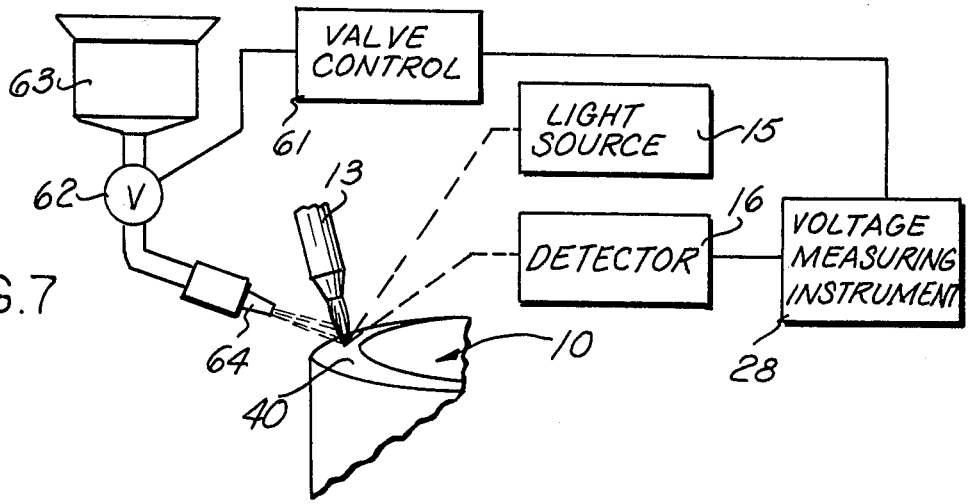
FIG. 7

APPARATUS FOR THERMAL DEPOSITION OF METAL

CROSS REFERENCE TO RELATED APPLICATIONS

This is a division of application Ser. No. 623,647 now U.S. Pat. No. 3,995,073, filed Oct. 20, 1975 and which in turn is a continuation-in-part of application Ser. No. 459,010, filed Apr. 8, 1974, now abandoned.

BACKGROUND OF THE INVENTION

1. Field of the Invention

This invention relates to the depositing of metal onto a surface of a metal article. Specifically, the invention is directed to the detection of an incipient change of phase from solid to liquid by means of a light beam in combination with a detection which is sensitive to the reflected light and which can distinguish the difference in reflections from a solid and a plastic body. The detection produces a control signal when incipient fusion is achieved, and the control signal is used to control deposit of metal on the surface.

2. Description of the Prior Art

Typical prior methods and apparatuses for depositing metal on a metal article have relied upon the attainment of a particular temperature in the workpiece as an indication of the appropriate time for applying the metal material, or reliance was placed upon the visual judgment of the operator. In such prior art methods and apparatuses, the workpiece is heated until the surface becomes molten and visually appears to be "wet" and when the surface is judged to be uniformly "wet", the metal material is applied. Due to variations in the composition of the material of the workpiece, melting temperature can fluctuate, and thus temperature measurement alone is not a reliable technique for determining surface melting. Further, relying on the judgment of the operator is not a efficient or reliable as automatic control.

SUMMARY OF THE INVENTION

The method of the present invention provides an indication of the precise point at which the metal material should be applied, namely, at incipient fusion of the base metal. To a substantial extent, this indication is much more precise through the present invention than could be obtained by instruments, such as an optical pyrometer or by visual observation by an operator.

In the preferred form of the present invention, apparatus for detecting incipient fusion includes a light source and a means such as a rotating shutter for modulating the output of the light source to produce a train of light pulses. These light pulses are directed onto the object being heated and means are provided for receiving the reflections of the train from the object. A photocell responsive to the reflected pulse train is used to generate an electrical signal in response to the reflected pulses which it receives. The electrical signal thus generated can be visually observed as by means of a cathode ray oscilloscope or it can be used to provide a controlling signal to a servomechanism or the like. The servomechanism can control the deposit of the material in a variety of ways by controlling a function or functions of the depositing apparatus, such as the feed of the material to be deposited.

Interference from ambient or extraneous light sources can be minimized by a suitable selection of the modulating frequency of the light source, and by employing a monochromatic source or a color-limiting filter and a photocell which is responsive to the output of the filter.

Accordingly, the present invention provides a precise indication of the time of incipient fusion and effects a control function in response thereto. The deposit of the metal on the surface is effected at the appropriate time and is not affected by the above-noted problem with regard to sensing of temperature of the workpiece. Further, obviously human error is avoided and eliminated, due to the fact that visual judgment is not utilized in the system to sense incipient fusion.

Applicants recognize that sensing the light reflectivity of a body being heated is old, such as shown in the Journal of Spacecraft and Rockets, Volume 6, January 1969, and specifically the article by Newman et al at page 72 thereof. However, the article does not disclose the sensing of incipient fusion of a metal workpiece, nor does the article relate to deposit of metal on a surface of the workpiece. Further, the article does not relate to controlling the depositing of metal on a surface in response to the sensing of incipient fusion.

BRIEF DESCRIPTION OF THE DRAWINGS

Other objects, features and advantages of the invention will be readily apparent from the following description of certain preferred embodiments thereof, taken in conjunction with the accompanying drawings, although variations and modifications may be effected without departing from the spirit and scope of the novel concepts of the disclosure, and in which:

FIG. 1 is a somewhat schematic view of an assembly for depositing material on a surface of a workpiece in accordance with the present invention;

FIG. 2 is a view partly in elevation and partly in cross section of a light modulating means and the detector which may be employed in the assembly of FIG. 1;

FIG. 3 is a circuit diagram including a photocell of the detector of FIG. 2;

FIG. 4 is a view of a cathode ray oscilloscope screen showing the type of indication presented when the surface of the workpiece to receive material has not yet reached fusion;

FIG. 5 is a view similar to FIG. 4 but showing the indication shown the surface of the workpiece reaches incipient fusion;

FIG. 6 is a schematic view of an apparatus embodying the invention; and

FIG. 7 is a schematic view of still another apparatus embodying the present invention.

DESCRIPTION OF THE PREFERRED EMBODIMENTS

In FIG. 1, reference numeral 10 indicates generally a metal workpiece to which a metal (weld) deposit is to be applied. As indicated by the arrow, the workpiece 10 is mounted for rotation about its axis in a suitable support (not shown). An oxyacetylene torch 13 or other suitable heating means directs its flame at the portion of the workpiece 10 to which a deposit of weld material from a weld filler rod is to be applied. The plastic or nonplastic condition of the workpiece 10 is monitored by the combination of a light source identified generally at reference numeral 15 which directs a modulated train of light pulses at the workpiece 10 and a detector generally indicated at numeral 16 which picks up the reflections from the workpiece.

A suitable light source and detector structure are illustrated in FIG. 2 of the drawings. The light source may, for example, be an incandescent bulb 17 which emits polychromatic light. Monochromatic light sources, such as lasers, are, however, equally usable. The bulb 17 is mounted within a rotating shutter 18 in which a plurality of spaced windows 19 are formed. The shutter is driven at a suitably high velocity by means of a drive motor 20. The output of the light source is a train of essentially square wave light pulses which are directed by means of one or more lenses 21 at the surface to be observed. Alternatively, one may use a fiber optic bundle to direct the light at the surface.

The detector may include a housing 22 at one end of which there are one or more lenses 23 which focus the reflected light through a band-limiting filter 24 onto a photocell 25.

The present invention takes advantage of the phenomenon that a molten surface is much more reflective than a solid surface immediately prior to melting. Prior to surface melting, any reflection from the surface of the workpiece 10 is diffuse. As the surface begins to melt, the reflection becomes specular so that more light goes into the lens system. The detector 16 focuses this reflected light through the filter 24 upon the photocell 25. The chromatic range of the filter 24 and the photocell 25 are selected so as to minimize the response to heat-induced radiation from the heated surface and radiation from the heating touches 13, thus avoiding saturation of the photocell. The filter and photocell responses may be centered in the yellow-green range, thus blocking the light in the blue and red spectra, which are prevalent in the ambient.

The response of the photocell 25 in the reflectometer detector varies as a function of the light impinging upon the surface of the photosensitive material of the photocell. The light emitted from the surface on which metal is to be deposited is composed of radiant energy due to its temperature, reflected ambient light, and reflected light from the modulated light source. The radiant porton is virtually steady state compared to the modulating frequency and is not a periodic function. The ambient light may be composed of time variable light, but when summed from the various sources, the time variations are minimized due to phase shifting. Suppression of ambient light variations may be obtained by appropriate selection of the light source modulating frequency and the detector time response sensitivity so as to minimize the effects of ambient light variations, such as those resulting from the 60 Hertz power line frequency. Consequently, the majority of the light variations being detected by the photocell and associated circuitry is due to reflection of the modulated light source beam from the workpiece surface.

Referring to FIG. 3, the photocell 25 is connected in series with a direct current power source 26 and a load resistor 27. The voltage across the load resistor 27 varies inversely as a function of the photocell resistance. An A.C. voltage measuring instrument provided with a blocking capacitor 29 is connected across the load register to measure only the time variable voltages and suppresses the slowly varying and steady state voltages. Therefore, an increase in time variable voltage indicates an increase in reflectance of time variable light. Since the workpiece on which material is being deposited is virtually a diffuse reflector during heating and a specular reflector when the surface melts, a sudden increase in the time variable voltage signifies surface melting.

It should be recognized that the voltage measuring instrument 28 may take a variety of forms, such as a voltmeter, a cathode ray oscilloscope, or the signals may be used as shown in FIG. 6 and 7 to operate a servosystem or the like to control the deposit of the material when the voltage variation across the load resistor 27 signifies that the surface is sufficiently plastic.

In FIG. 4 there is shown a cathode ray oscilloscope screen 30 having a trace 31 thereon which is indicative of the absence of significant time variable voltage. FIG. 5 illustrates a trace 32 which is obtained when the detector circuit is receiving a considerable amount of reflected modulated light, indicative of surface melting. Comparison of these two figures shows the significant increase in reflectivity of the workpiece surface when fusion is achieved.

Unlike optical pyrometers or radiation thermometers, the detection apparatus of the present invention does not detect surface melting by temperature measurement as such, but rather by sensing the phase change from solid to liquid. Determination of the surface temperature by radiation thermometry is limited in accuracy by the precision of the emissivity function for the material being measured, since the radiated energy from any object due to the temperature is a function of the temperature and the emissivity.

Using heating time as a method for signaling surface melting is unreliable due to fluctuations in the surrounding environment. Although the energy being released by an oxyacetylene torch or other heating means can be determined or calculated with appropriate apparatus, the energy being absorbed by the material being heated is influenced by many factors. The most significant factor is the presence of ambient air currents which tend to remove heat from both the oxyacetylene flame and the surface being heated. Also, the material composition and the surface conditions influence the rate at which heat is absorbed.

In addition, due to variations in the material composition, temperature measurement alone is not a reliable technique for determining surfac melting. With each class or grade of various metals, the compositional ranges for the constituent elements cause the melting point temperature to fluctuate. Therefore, melting is not a function solely of temperature, but also of metallurgical composition.

The system of the present invention has numerous advantages over the types of systems previously used. The system signals melting by optically measuring the surface reflectance as the material changes from the solid to the liquid phase, rather than by heating time, temperature or some less accurate indication of surface melting. Also, operator judgment and error is eliminated.

The fundamental frequency of the modulated light source is arbitrary and cane be adjusted so as to minimize the effects of other time variable light sources. Typically, the modulating frequency is not near a multiple of 50 or 60 Hertz, but is high enough to allow several cycles to occur during the transistion from diffuse to specular reflection. The system does not respond to variation in temperature induced radiation because such radiation varies slowly compared to the modulating frequency of the light source. Moreover, energy peaks in the red and infrared light spectra which might saturate the photosensitive device can be suppressed by a suitable filter. Similarly, light from oxyacetylene torches and most other heating devices can be eliminated, since the light is of an essentially steady state nature; here too, the sensitivity range of the filter and the photocell can be chosen to avoid its spectral peaks.

As noted hereinabove, the present invention provides a control of the deposit of metal onto the surface of the workpiece when the surface has reached the point of incipient fusion. The control of the deposit of metal can be effected by control of a function or functions in automatic equipment in response to the detector 16 sensing incipient fusion. Specifically, when the detector 16 senses incipient fusion, an electrical control signal is provided which is applied to suitable servomechanism to control a function in the automatic equipment.

FIG. 6 illustrates the invention for automatic control and application of metal to a surface 40 of a metal workpiece 10. The workpiece is mounted in a workholder 41 so that it can be rotatably driven by a driving motor 46 which has an output shaft 44 with a gear 43 which meshes with ring gear 42 on the workholder 41 so as to drive the workpiece 10 and holder 41. A motor control 47 is connected to motor 46 and has a control knob 48 for adjusting the application of power from power supply 50. The motor control 47 receives an output from the voltage measuring instrument 28 and causes the motor 46 to drive the workpiece 10 at a speed such that the surface 40 is heated to a temperature by torch 13 at which it reaches the condition of incipient fusion as detected by detector 16.

Metal is added to the metal surface 40 when it is at a temperature of incipient fusion from metal rod 57 which terminates near the surface 40 and melts and coats such surface. Rod 57 is supplied by a reel 58 mounted on a supporting shaft 59 and is controlled by a feed mechanism 56 which has a drive wheel 54 which engages the rod 57 to drive it toward the surface 40. A second drive motor 53 drives wheel 54 and receives an input from a second motor control 51. Motor control 51 receives a power supply 50 and an input control signal from the voltage measuring instrument 28. A control knob 52 allows the gain of the motor control 51 to be manually set.

In operation, the motor controls 47 and 51 are set by knobs 48 and 52 such that the motor 46 turns the workpiece 10 such that the surface 40 under the torch is at the point of incipient fusion. The motor 53 supplies rod to the surface 40 in the region of incipient fusion at a rate such that the desired amount of metal is applied to surface 40.

Thus, the detector 16 in the embodiment of FIG. 6 controls both the speed of rotation of the workpiece and the rate of feed of rod 57. By adjusting motor controls 47 and 51, optimum results will be obtained.

For example, at initiation of operation, the torch is lighted and motor 46 preferably rotates the workpiece until the surface 40 reaches the condition of incipient fusion. At such condition, the detector 16 produces an output which controls motor 46 to control rotational speed of the workpiece 10. In addition, metal feed is initiated by energizing motor 53.

FIG. 7 illustrates a modified system embodying the invention wherein powdered metal is sprayed onto surface 40 instead of using a rod as in FIG. 6.

The workpiece is rotated by motor 46 under control of detector 16, as in FIG. 6, but such structure is not illustrated. Powdered metal is fed from reservoir 63 through valve 62 to nozzle 64 which sprays it onto metal surface 40 in the area under incipient fusion. A valve control 61, which can be a solenoid, controls valve 62 and receives an input from voltage measuring instrument 28. The output of detector 16 thus detects the condition of incipient fusion of surface 40 and drives the workpiece through motor 46 and controls valve 62 to apply the proper amount of material to surface 40.

It should be evident that various modifications may be made to the described invention without departing from the spirit and scope of the invention.

What we claim is:

1. Apparatus for depositing metal on a surface of an article comprising, means for heating at least the surface of the article to a state of incipient fusion, means for directing a light beam at the surface during heating, means for detecting the light reflectively of the surface including reflectivity at the time of incipient fusion and for creating an electrical control signal from the light reflections from the surface at the time of incipient fusion of the surface, means for effecting deposit of the metal on the surface after incipient fusion thereof, and means for controlling the deposit of metal on the surface in response to said electrical control signal.

2. The apparatus of claim 1 in which said means for directing said light means comprises means for producing and directing a light beam composed of time modulated polychromatic light.

3. The apparatus of claim 1 in which said means for detecting includes a photocell and a voltage generating means for generating a time varying voltage from the reflections.

4. The apparatus of claim 3 which includes a monochromatic filter positioned to deliver a monochromatic beam of reflected light to said photocell.

5. The apparatus of claim 2 in which the modulated light beam is produced by means of a light bulb and a rotating shutter.

6. Apparatus as defined in claim 1 wherein said means for effecting deposit of the metal includes means for feeding the metal to the workpiece and said means for controlling comprises means for initiating feed of the metal in response to said electrical signal.

7. Apparatusas defined in claim 1 further including means for rotating the workpiece while material is deposited thereon.

8. Apparatus as defined in claim 6 wherein said material is contained in a weld rod and said feed means comprises drive means for moving said rod.

9. Apparatus as defined in claim 6 wherein said metal is a powder flame spray mixture and said claim feed means comprises a valve for controlling feed of said powder mixture.

* * * * *

UNITED STATES PATENT AND TRADEMARK OFFICE

CERTIFICATE OF CORRECTION

PATENT NO. : 4,046,100

DATED : September 6, 1977

INVENTOR(S) : Frederick L. Kuonen and Edward M. Boughton

It is certified that error appears in the above-identified patent and that said Letters Patent are hereby corrected as shown below:

Column 6, line 60, after "said" delete "claim".

Signed and Sealed this

*Twentieth* Day of *December 1977*

[SEAL]

*Attest:*

RUTH C. MASON
*Attesting Officer*

LUTRELLE F. PARKER
*Acting Commissioner of Patents and Trademarks*